United States Patent [19]

Raeburn

[11] Patent Number: 4,494,629

[45] Date of Patent: Jan. 22, 1985

[54] LOWERING DEVICE AND METHOD

[76] Inventor: John L. Raeburn, 5 Dunstan Close, East End Rd., London N 2, England

[21] Appl. No.: 406,983

[22] Filed: Aug. 10, 1982

[30] Foreign Application Priority Data

Aug. 12, 1981 [GB] United Kingdom ..... 8124659

[51] Int. Cl.[3] ..... B65H 59/14

[52] U.S. Cl. ..... 188/65.5; 182/7; 188/65.2; 242/154

[58] Field of Search ..... 188/65.1–65.5; 242/107.2, 107.3, 153, 154; 182/5, 6, 7; 226/195

[56] References Cited

U.S. PATENT DOCUMENTS

| | | | |
|---|---|---|---|
| 311,039 | 1/1885 | Scheidt et al. | 188/65.4 X |
| 1,370,306 | 3/1921 | Griest | 182/90 |
| 2,557,483 | 6/1951 | Tarasiuk | 111/92 |
| 3,532,189 | 10/1970 | Wade | 188/65.5 X |
| 3,760,901 | 9/1973 | Hynes | 182/7 |
| 3,826,341 | 7/1974 | Ledner | 188/65.5 |
| 4,157,127 | 6/1979 | Katsube | 188/65.5 X |

FOREIGN PATENT DOCUMENTS

| | | | |
|---|---|---|---|
| 5864 | 6/1879 | Fed. Rep. of Germany . | |
| 93333 | 7/1896 | Fed. Rep. of Germany | 188/65.4 |
| 154282 | 9/1904 | Fed. Rep. of Germany . | |
| 2231844 | 1/1974 | Fed. Rep. of Germany . | |
| 2439678 | 3/1976 | Fed. Rep. of Germany . | |
| 7238829 | 5/1974 | France . | |
| 6421 | 4/1892 | United Kingdom | 188/65.4 |
| 6150 | 3/1912 | United Kingdom | 188/65.4 |
| 214374 | 4/1924 | United Kingdom . | |
| 2024912 | 6/1979 | United Kingdom . | |
| 2057871 | 4/1981 | United Kingdom . | |

OTHER PUBLICATIONS

United Kingdom, No. 6421, A.D. 1892, (Pride).

European Search Report, European Patent Office, EP 82 30 4225.4.

*Primary Examiner*—Duane A. Reger

*Assistant Examiner*—Michael P. Gilday

*Attorney, Agent, or Firm*—Cushman, Darby & Cushman

[57] ABSTRACT

A lowering device for lowering a person or other load comprises a line for lowering the load and a support structure through which the line runs during lowering. In some modes of operation a free end of the line is secured to a fixed point, and the support structure is secured to the person and travels with the person down the line. In other modes the support structure is secured to a fixed point, and the load is secured to a free end of the line and is lowered downwardly away from the support structure. Pivotably mounted on the support structure is a transverse guide member carrying a fixed guide element at each end thereof and a rotatable guide element at the center thereof. The line passes around the guide elements and under the effect of load tension the transverse member pivots to bring the guide elements on the member into a pinching effect with guide elements which are fixed on the support structure. Variation of speed of the rope through the support structure is achieved by rotating an external lever coupled to the transverse member. The rope may follow various routes through the support structure entering and exiting at selected openings to produce different effects.

14 Claims, 11 Drawing Figures

LOWERING DEVICE AND METHOD

The present invention relates to a device for, and a method of, lowering a load on a line, and is concerned in particular, but not exclusively, with a device for use in lowering persons to safety from high buildings, oil rigs, ships decks, and the like during fire or other emergency.

It is known to provide various lowering devices in which a person is secured by harness to a support structure which is engaged with a line which is secured at a fixed point from which the person is to be lowered. The line is engaged with the support structure in such a manner that upon lowering of the load the line runs through the support structure, and there is provided with the support structure speed limiting means for limiting speed at which the line runs through the support structure. The speed limiting means is manually adjustable to allow control of said speed. It is also known in some of these devices to provide that tension in the line due to the weight of the person being lowered, acts to operate a fail safe mechanism which increases the braking effect in proportion to the load tension in the line. In such a case, the speed limiting means may have a manual lever to allow the person descending to reduce the braking effect due to the load tension in the line.

Known devices of this kind are disclosed, inter alia, in British Patent Specification Nos. 6150/12 (Davidson), 479,474 (Arle), 1125774 (Aviation), and 1580329 (Styles), and in published pending UK Patent Application No. 2024912A (Lewis).

Such devices are in general of a symmetrical configuration, and are of limited usefulness in that normally operation in one direction only is possible. Known devices also sometimes suffer from jamming, excessive wear, and imperfect operation due to shock loads, and jamming.

There have also been proposed various forms of pulley systems for lowering persons and goods, and these may provide a symmetrical arrangement of pulleys. One such example is shown in British Patent Specification No. 214374 (Carroll), but no means for varying the rate of descent is provided in this disclosure.

It is an object of the present invention, at least in preferred embodiments thereof, to provide a lowering device which is compact and easily stored, is relatively inexpensive, and which can be made to be suitable for lowering persons and loads of differing weights, in safety and at an appropriate chosen speed. It is a particular object of the present invention, at least in preferred embodiments thereof, to provide a lowering device of great versatility which can be used in a number of different modes to fulfill different functions.

According to the present invention there is provided a lowering device comprising a line for lowering a load, a support structure engaged with the line in such a manner that upon lowering of the load the line runs through the support structure, a transverse pivoted guide member positioned transversely relative to the main extended length of the line in operation, the transverse guide member having two primary guide elements mounted thereon in spaced apart relationship and the transverse guide member being pivotally mounted on the support structure at a pivot axis substantially midway between the two primary guide elements, and manual control means coupled to the transverse guide member to effect pivotal movement thereof by an operator, the line being threaded along a path through the support structure such that the line passes around and bears against both primary guide elements on the transverse guide member and experiences a braking effect thereby, the path of the line through the support structure being such that tension in the line due to a load in operation produces a turning moment on the transverse guide member which pivots the transverse guide member to bring each primary guide element towards an associated secondary guide element mounted on the support structure with the line between the associated primary and secondary guide elements to increase the braking effect on the line, the manual control means being operable to increase or decrease the braking effect by turning the transverse guide member in the same or the opposite sense to the effect of the load tension in the line.

It is a particularly preferred feature of the invention that it may be arranged that the path of the line through the support structure is such that load tension in the line acting in either direction along the line produces a turning moment on the transverse guide member, and an arrangement of secondary guide elements is provided such that pivoting of the transverse guide member in either direction brings each primary guide element towards an associated secondary guide element to increase the braking effect on the line.

Such an arrangement allows the device to be used to lower loads with the line running through the support structure in either direction. This has application for example where a number of persons are to be lowered from a high point in an emergency. A person can be lowered using the device, the harness can be pulled back up to the high point, and a further person can be lowered attached to the opposite end of the line from the first person so that there is no need to re-thread the line back through the device before use by a second person. The particular manner in which such an arrangement can be operated will be described in more detail hereinafter.

In preferred forms of the device according to the invention there may be mounted on the transverse guide member midway between the two primary guide elements a further, tertiary guide element, said tertiary guide element being adapted for said line to pass around during passage of said line from one primary guide element to the other.

It is preferred that the tertiary guide member is mounted to be freely rotatable on the support structure. In such an arrangement the line can be arranged to follow a path around one of the primary guide elements, can turn back on itself between the two primary guide elements, and then can follow a path around the secondary guide element. In the region between the two guide elements where the line turns back on itself, it can run freely against the tertiary guide element.

It is a particular feature of the present invention that a single support structure with primary and secondary guide elements, and optionally a tertiary guide element, can be provided which may perform several different functions, depending upon the route of the line which passes through the support structure.

In one preferred arrangement of a device according to the invention, the route of the line through the support structure comprises a path through an opening in the support structure, a path around an arc of a first secondary guide element, a path between the first, secondary guide element and a first, primary guide element, a path around an arc of the first, primary guide element, a path between the two primary guide elements leading back towards the said opening, a path around an arc of the second primary guide element returning to a direction away from the said opening, a path between the second primary guide element and a second, secondary guide element, a path around an arc of the second secondary guide element, and a path through a further opening in the support structure, said further opening being positioned at a region of the support structure remote from the first opening with the guide member and the guide elements arranged in a region between the two openings.

Such an arrangement is suitable for use where one end of the line is secured to a fixed point and the load is secured to the support structure which is arranged to travel with the load down the line. Alternatively the said arrangement is suitable for use where the support structure is secured at a fixed point and the load is secured to one free end of the line and is lowered relative to the support structure.

In accordance with another arrangement in a preferred form of the device, the route of the line through the support structure comprises a path through an opening in the support structure, a path around an arc of a first secondary guide element, a path between the first secondary guide element and a first primary guide element, a path around an arc of the first primary guide element, a path between the first primary guide element and a second secondary guide element, a path around an arc of the second secondary guide element, a path around further guide means leading back to a direction towards the said opening, a path around an arc of a third, secondary guide element, a path between the third secondary guide element and the second primary guide element, a path around an arc of the second primary guide element, a path between the second primary guide element and a fourth secondary guide element, a path around an arc of the fourth secondary guide element, and a path through a further opening in the support structure, said further opening being positioned adjacent the first mentioned opening.

Such an arrangement is suitable for use where the support structure is secured at a fixed point and the load is secured to one free end of the line and is lowered from the support structure.

In accordance with yet another alternative arrangement, it may be arranged that the route of the line through the support structure comprises a path through an opening in the support structure, a path around an arc of a first, secondary guide element, a path between the first secondary guide element and a first primary guide element, a path around an arc of the first primary guide element leading back toward the opening, a path between the first primary guide element and the tertiary guide element, a path around an arc of the tertiary guide element returning to a direction away from the opening, a path between the tertiary guide element and the second primary guide element, a path around an arc of the second primary guide element leading to a direction towards the said opening, a path between the second primary guide element and a second, secondary guide element, a path around an arc of the second secondary guide element, and a path through a further opening in the support structure, said further opening being positioned adjacent the first mentioned opening.

Such an arrangement is applicable where the support structure is secured at a fixed point and the load is secured to one free end of the line and is lowered from the support structure.

The various guide elements are each curved appropriately to allow the passage of the line around the required arc thereof, and in general terms the arc need not be a circular arc. However it is preferred that the periphery of each guide element, at least over the portion contacted by the line, is circular.

Preferably the primary guide elements are fixed relative to the transverse guide member, and it is also preferred that the secondary guide elements are fixed relative to the support structure.

In a particularly preferred form of the invention, the primary and secondary guide elements are positioned in a symmetrical arrangement on either side of a central longitudinal axis of the support structure, the said longitudinal axis passing through the said pivot axis of the guide member, and also being approximately aligned along the direction of the main extended length of the line in operation.

In one form of such an arrangement, four secondary guide elements are provided with their centres at the corners of a rectangle, the secondary guide elements being positioned approximately in pairs opposite each other on either side of the central longitudinal axis, each pair of secondary guide elements being positioned on either side of a primary guide element.

Preferably the manual control means comprises an elongate control member aligned transversely of the main extended length of the line in operation and mounted for pivotal movement substantially about the mid point of the member, the elongate control member being adapted for two handed manual operation with one hand on either side of the pivot axis of the member.

Also preferably there is provided in the region of each opening in the support structure for the line, tension means for placing a restriction on the passage of the line through the opening in order to tension the line during its passage through the support structure.

The tension means may be provided by a number of devices. For example there may be provided in the region of an opening in the support structure for the line a pair of pinch rollers for the line to pass between for applying a restraint to passage of the line so as to tension the line during its passage through the support structure. Alternatively or in addition there may be provided in the region of at least one opening in the support structure for the line a pivoted tubular member through which the line passes, and adjustment means for varying the angle of the tubular means relative to the main extended length of the line in operation, for varying the restraint exerted on the line by the tubular member during the passage of the line therethrough.

There is also provided in accordance with the present invention a method of lowering a load utilising a device in accordance with the present invention as set out hereinbefore. In one form such a method may comprise the steps of engaging the line with the support structure, securing one end of the line at a fixed point, coupling the support structure to a person to be lowered, lowering the person by gravity downwards from the said fixed point, and adjusting the speed of descent by movements of the manual control means by the person descending.

In another form the method may comprise the steps of engaging the line with the support structure, securing the support structure to a fixed point, securing a free end of the line to the load, lowering the load from the fixed point at which the support structure is secured, and adjusting the speed of descent by movements of the manual control means by a person at the said fixed point.

A number of preferred features of the invention have been set out, and in one preferred combination of these features there is provided a lowering device comprising a line for lowering a load, a support structure engaged with the line in such a manner that upon lowering of the load the line runs through the support structure, a transverse pivoted guide member positioned transversely relative to the main extended length of the line in operation, two primary guide elements fixedly mounted on the transverse guide member in spaced apart relationship, the transverse guide member being pivotally mounted on the support structure at a pivot axis substantially midway between the two primary guide elements, a tertiary guide element mounted on the transverse guide member midway between the two primary guide elements, said tertiary guide element being mounted to be freely rotatable on the transverse guide member, a plurality of secondary guide elements fixedly mounted in a symmetrical arrangement on the support structure, a manual control member aligned transversely of the main extended length of the line in operation and mounted coaxially with the transverse guide member for pivotal movement substantially about the mid-point of the control member, the control member being adapted for two-handed manual operation with one hand on either side of the pivot axis of the member, the control member being coupled to the guide member in such a manner as to effect pivotal movement of the transverse guide member by turning movement of the control member by an operator, the line being threaded along a path through the support structure such that the line passes around and bears against both primary guide elements on the transverse guide member and experiences a braking effect thereby, the path of the line through the support structure being such that tension in the line due to a load in operation produces a turning moment on the transverse guide member which pivots the transverse guide member to bring each primary guide element towards an associated one of the said secondary guide elements with the line between the associated primary and secondary guide elements to increase the braking effect on the line, the path of the line being such that load tension in the line acting in either direction along the line produces a turning moment on the transverse guide member, the manual control member being operable to increase or decrease the braking effect by turning the transverse guide member in the same or the opposite sense to the effect of the load tension in the line.

Considering now various details of the device according to the invention, conveniently the line comprises a rope, preferably being a pleated rope having a terylene core and a woven portion on the outside of the core. However it will be appreciated that other forms of line may be used, for example any suitable rope, cord, belt or even possibly a fine chain.

The invention finds particular application where the support structure is suitable to cooperate with a harness for coupling a human being to the line, the human being constituting the said load.

An embodiment of the invention will now be described by way of example with reference to the accompanying drawings in which.

Figure 5:
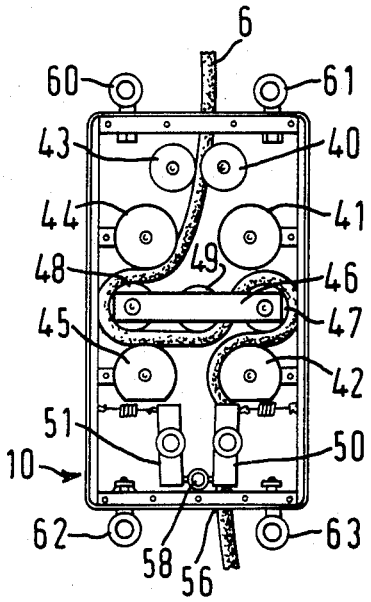
Figure 5A:
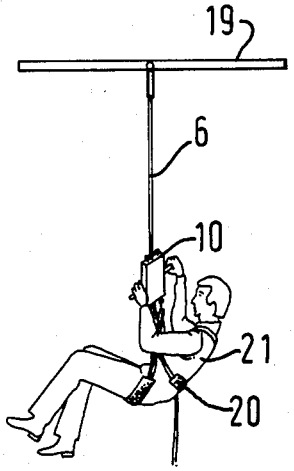
Figure 6:
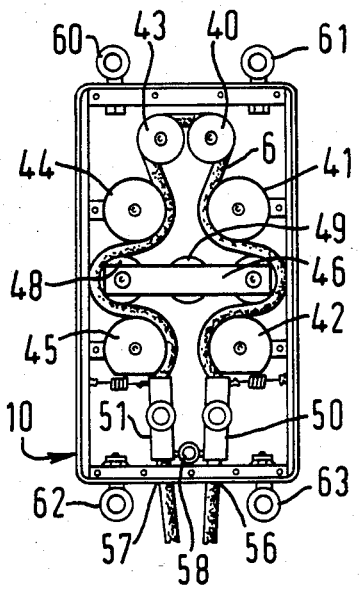
Figure 7:
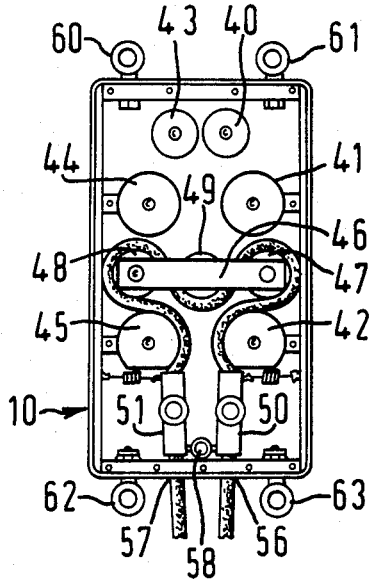
Figure 6A:
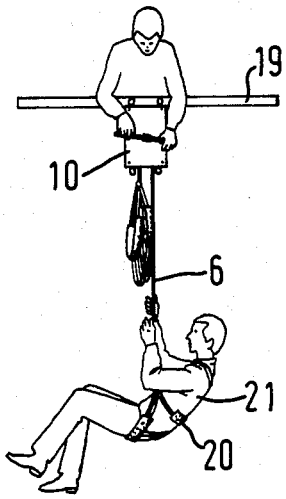
Figure 7A:
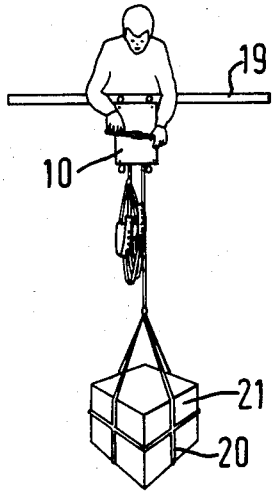

FIGS. 5 and 5*a* are similar diagrammatic views showing in a second mode of use;

FIGS. 6 and 6*a* are similar diagrammatic views of the device when used in a third mode of operation; and FIGS. 7 and 7*a* are similar diagrammatic views of the device when used in a fourth mode of operation.

Figure 1:
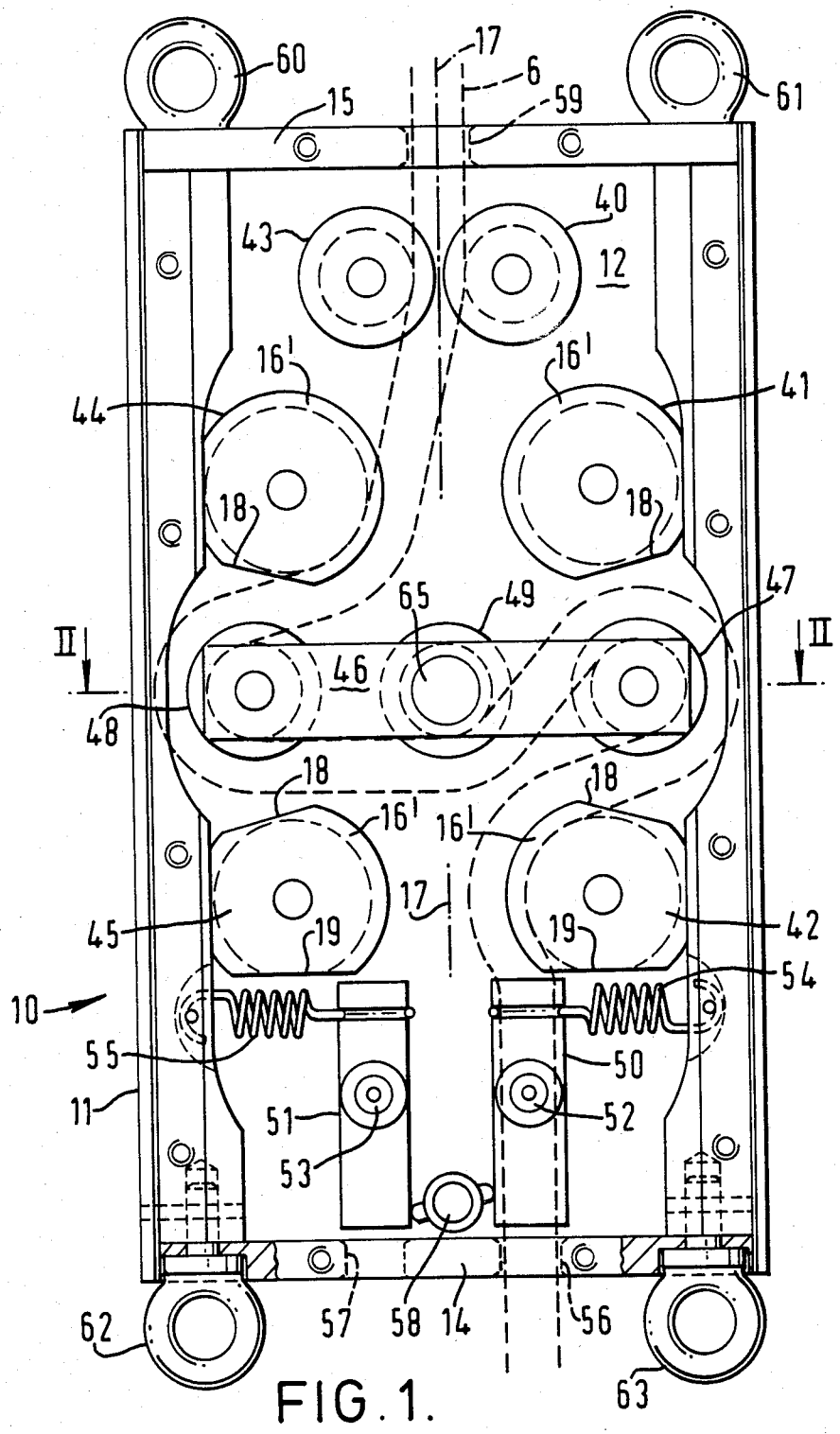
FIG. 1 shows a side view of a lowering device embodying the invention, with a cover plate removed from one major face.
Figure 2:
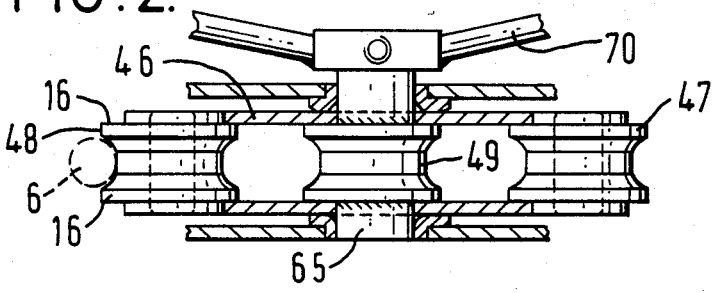
FIG. 2 is a cross-section taken along the lines II—II in FIG. 1.
Figure 3:
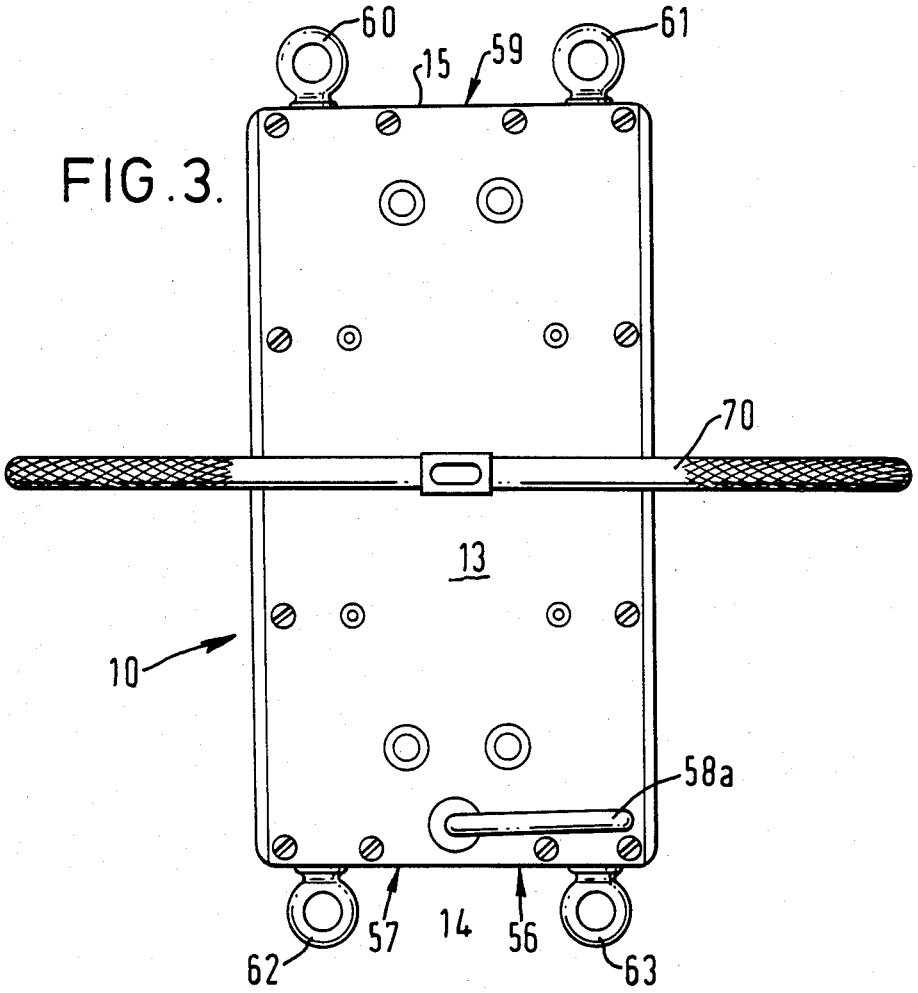
FIG. 3 is a side view of the lowering device shown in FIG. 1, but with the cover plate in place.

Referring first to FIGS. 1 to 3, there will be described the basic structure of an embodiment of the lowering device according to the invention, and examples of its use will then be described with reference to FIGS. 4 to 7*a*. The lowering device comprises a support structure indicated generally at 10, engaged with a line indicated diagrammatically at 6, in such a manner that in operation during lowering of a load the line 6 runs through the support structure 10. The support structure 10 comprises a housing 11 having two major faces of which one comprises a base wall 12 and the other comprises a cover 13, shown in FIG. 3. The housing also has end walls 14 and 15.

At the centre of the support structure 10 a transverse guide member 46 is pivotally mounted on the support structure 10 at a pivot shaft 65, and is coupled by way of the same shaft 65 to a manual control member 70 which consists of a transverse bar adapted for two-hand operation by an operator with one hand on either side of the pivot shaft 65. The control member 70 is rigidly coupled to the transverse guide member 46 so that pivoting of the control member 70 produces corresponding pivoting of the guide member 46.

Mounted on the guide member 46 are two primary guide elements 47 and 48, mounted one at each end of the guide member 46 equidistant from the shaft 65 and fixedly mounted relative to the guide member 46. Each of the guide elements 48 and 47 is in the form of a pulley wheel with rims 16 so that the rope 6 is located between the rims, but although the guide element 47 or 48 is in the shape of a pulley, it is not rotatable on the guide member 46.

A further guide element 49 is also mounted on the guide member 46, and consists of a freely rotatable pulley 49 of the same diameter and shape as the fixed guide elements 47 and 48. The guide element 49 constitutes a tertiary guide element, and is freely rotatable relative to the transverse guide member 46, on the same pulley shaft 65 about which the member 46 pivots.

Mounted on the base wall 12 are four secondary guide elements 41, 42, 44 and 45, which are positioned symmetrically relative to a longitudinal central axis indicated at 17, running through the pivot axis of the member 46, and generally aligned along the direction of the main extended length of the rope 6. (As will be appreciated during subsequent description of operation of the device, the axis 17 is not necessarily parallel to the main extended length of the rope 6, since a slight inclination will be placed on the support structure 10 when the rope 6 enters centrally and exits slightly to one side of the axis 17.) Each of the secondary guide elements 41, 42 44 and 45 has the general shape of a pulley wheel, and has a pair of rims 16' similar to the primary guide elements 47 and 48, but the secondary guide elements 41, 42, 44 and 45 are of larger diameter, and have flats 18 cut on them to a depth such as to form a tangent to the circle at the base of the depression formed by the rims 16' of the secondary guide elements. Further flats 19 are formed on the secondary elements 42 and 45, but these are taken to a greater depth than the flats 18. The purpose of the flats 18 is to allow cooperation between primary and secondary guide elements, as will be described hereinafter. The purpose of the flats 19 is merely to provide space for springs 54 and 55, which will be described hereinafter.

At the end of the support structure 10 closed by the end wall 15, there is a single opening 59 in the end wall 15 to allow passage, either entry or exit, of the rope 6. Adjacent the opening 59 are two further freely rotating pulleys 40 and 43 which are generally of similar construction to the pulley element 49, and which are spaced apart sufficiently for the rope 6 to just pass between the two pulleys 40 and 43. The purpose of the pulleys 40 and 43 is to exert a tensioning effect on the rope during its passage through the support structure 10.

At the end of the support structure 10 closed by the end wall 14, there are provided two openings 56 and 57 in the end wall 14 for passage of the line 6, either entry or exit. Adjacent the opening 56 and 57 are two tubular rope guides 50 and 51 which act as locking tubes. Each is pivoted approximately at its centre point on stub axles 52 and 53. At the inner ends thereof the locking tubes 50 and 51 are pulled away from each other by springs 54 and 55 into a resting position (not shown) in which they are slightly out of line with the apertures 56 and 57 in the end wall of the housing. At the outer ends thereof there is arranged between the two tubular members 50 and 51 a cam device 58 which can be manipulated from outside the casing by a hand-lever 58A (FIG. 3) to urge the two guide tubes 50 and 51 apart at their lower ends, thus bringing them into alignment with the apertures 56 and 57 (as shown). The purpose of these tubular members 50 and 51 is to tension the rope 6 passing through the support structure 10, and the purpose of the cam 58 is to provide two different adjustments of the tubular members 50 and 51 so as to provide two different degrees of restriction on the rope passing through the support structure 10. This affords the ability to set two different basic rates of descent of a load.

At its two ends, the housing 11 carries pairs of eye bolts 60, 61, 62 and 63. These pairs of bolts may be used in various modes of operation for securing the support structure 10 to a fixed point, or to a harness carrying a load.

Figure 4:
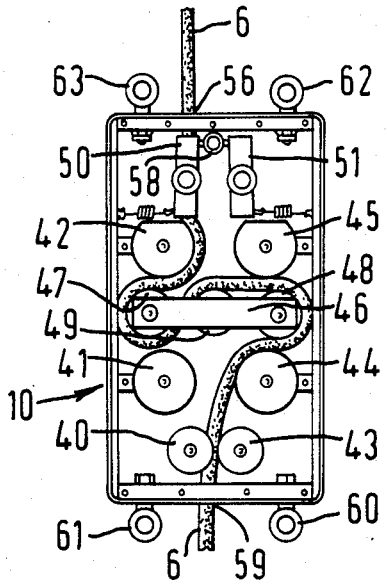
FIG. 4 is a diagrammatic side view of the device shown in FIGS. 1 to 3, in a first operative mode.

In FIGS. 4 and 4*a*, 5, and 5*a*, 6 and 6*a* and 7 and 7*a*, there are shown four different modes of operation of the lowering device. The path of the rope 6 through the support structure 10 in the first and second modes, shown in FIGS. 4 and 5, is the same, but the support structure 10 is inverted between the two modes. The route shown in FIG. 5 is the same as the route shown in FIG. 1, and this rope, and its effective use, will first be described with reference to FIGS. 5 and 5*a*, and also with reference to FIGS. 1 to 4, because the particular route concerned is also shown in these more detailed figures.

Referring to FIGS. 1, 5 and 5*a*, a free end of the rope 6 is secured at a fixed point 19 and the eye bolts 62 and 63 are attached to a harness 20 holding the load comprising a person 21. The route of the rope 6 as it passes through the support structure 10 is that the rope 6 enters through opening 56, passes along tube member 50, around the secondary guide element 42, and around the primary guide element 47. The rope 6 then passes back towards the opening 56 as it passes between primary guide element 47 and tertiary guide element 49, and the rope then passes around part of guide element 49, around primary guide element 48, and returns to its former direction away from opening 56. The rope 6 then passes around secondary guide element 44, between tensioning pulleys 40 and 43, and exits through opening 59. When used in this configuration, the pulleys 41,45 are not used and neither is the locking tube 51. The operation of the device in this mode is as follows.

With the free end of the rope 6, that is to say the upper end which emerges through aperture 59, made fast to the secure location, and a weight, such as the person to be lowered, secured from eye bolts 62 and 63, tension is applied to the rope 6 and this tension operates to draw the right hand end of arm 46 down so as to increase the wrap of the rope around the guide element 42 and pinch the rope between elements 47 and 42. The tightness with which the rope is pinched will obviously depend upon the weight of the load to be lowered. The rope will similarly be pinched between the elements 48 and 44. A further restraint will be put upon the rope by the locking tube 50 which, without the cam 58 engaged, is pivoted by spring 54 so as to be out of line with the aperture 56, thus applying a kink to the rope which restricts its freedom of movement through the locking tube 50. It is preferably arranged that the restraints thus applied to the rope are adequate to lock the mechanism against any downward movement of the device on the rope. However, if the cam 58 is now operated to bring locking tube 50 into alignment with entry aperture 50 as shown in FIG. 5, some restraint will be removed from the rope and it is preferably so arranged so that the device will now move slowly down the rope. The speed at which it moves will depend upon the geometry of the arrangement which includes the diameter of the rope in relation to the pulleys round which it passes, and upon the 'stiffness' or flexibility of the rope as well as the coefficient of friction between the surface of the rope and the pulleys. However, the speed will be substantially independent of the weight applied. This is because the arrangement is self adjusting since the pressure with which the rope is pinched between pulleys 47 and 42 on the one hand and 48 and 44 on the other is dependent upon the weight applied. The device can thus be used in this configuration to lower itself, with the load, at a substantially uniform pace. Assuming that the device is to be used to lower a human being, either alone or accompanied by an inanimate load, a further facility can, however, be provided. The shaft 65 on which arm 46 is mounted is brought out of housing 11 through a suitable bearing and carries out-side the housing 11 the cross lever 70 (FIG. 3) by which arm 46 can be manipulated by a person riding on the device. If this lever is used to pull down on the arm 46 on the left hand end as seen in the drawing, pressure on the rope 6 between the two pairs of elements 42,47 and 44,48, can be eased, so that friction of the rope upon the pulleys will be reduced and restraint thereby lessened. This will enable the load to travel downwardly faster. On the other hand pressure on the other end of the hand lever to turn arm 46 clockwise will increase these pressures and thus restrain the descent of the load. By manipulation of the external hand lever therefore a completely controlled descent is possible.

In FIGS. 4 and 4(*a*), a further mode of operation is shown. Here the same rope route is used as in FIG. 5, but the support structure 11 is inverted and secured to the base of a derrick 22. The rope 6 passes over two external pulleys 23 and 24, and then supports a person 21 in a harness 20.

A third mode of employment of this embodiment is illustrated in FIG. 6. In this arrangement the rope enters through aperture 57, passes through locking tube 51, passes around guide element 45, round the outside of element 48, inside element 44, round the outside of element 43 and then across to the outside of element 40 and back down the other side of the device in a path symmetrical to that above described, finally leaving through locking tube 50 and exit aperture 56. With this configuration of the device it is intended to be operated from the top of the drop to be negotiated where it is suspended from a secure location by eye bolts 60 and 61. Since the arrangement is entirely symmetrical a load can be applied to either end of the rope below the housing and no movement will take place so long as the cam 58 is in the correct position to provide restraint at both of the locking tubes 50 and 51. Assuming that the load is put upon the right hand run of the rope as seen in the drawing, tension in the rope will tend to pull the right hand end of the arm 56 downwardly to pinch the rope between elements 47 and 42. Similarly the rope will be pinched between elements 48 and 44 on the left hand side. Thus, when the cam 58 is operated to remove the restraint of the locking tubes 50 and 51, the load will still not descend. In order to lower the load the manual lever operating arm 46 must be manipulated to turn arm 46 anti-clockwise. This will relieve the restraint on the rope due to the pinch between elements 47 and 42 (and between 48 and 44) and the load will be allowed to descend at a rate which is controllable according to how far the arm 46 is moved. However, the maximum rate of descent is limited by the friction within the device which will be determined, as has been explained, above by the geometry of the guide pulleys and the thickness of the rope. The use of the device in this configuration is particularly suitable for rescue operations where disabled persons are required to be lowered from a height. Since the device remains at the top of the drop it can be manipulated by a skilled supervisor to lower a patient at a well-controlled slow rate which can be halted at any time. It will moreover be appreciated that the left hand run of the rope (as seen in the drawing) will rise into the machine as the right hand run carrying the load falls. This means that when the descent has been completed with the right hand run of the rope a new load can be attached to the left hand run and so the two sides of the equipment can come into use alternatively to maintain a fast turnround.

In FIGS. 7 and 7*a* a fourth mode of use of this device is illustrated. It is in fact in many respects similar to that last described with reference to FIG. 6, but it is adaptable for use in more vigorous situations where a faster descent is tolerable.

In this configuration the rope passes, as before, in through locking tube 51 over element 45 and round element 48. It then passes under element 49 and over element 47, then round element 42 and out through locking tube 50. The shorter path of the rope in this configuration involves less frictional drag upon the rope by frictional engagement with the guide elements. In other respects the operation of the device in this configuration is similar to that described above with reference to FIG. 6 but it is preferably arranged that even with the cam 58 set into the 'locking' position the restraint put upon the rope when a load is applied is insufficient to prevent a slow descent of the load. The operation of the device will now take the following form.

When the load is applied, say on the right hand run of the rope as seen in FIG. 7 the arm 46 will be turned clockwise and restrain the passage of the rope by pinching it between elements 42 and 47, and 48 and 44 as in the previous configuration. This is down with cam 58 set into the 'on' position that is to say with the kink applied to the rope between the tube 50 and outlet aperture 56 and between the inlet aperture 57 and tube 51. As has been stated above this does not prevent the load beginning to descend at a slow rate. As will be understood the device in this configuration is suspended on eye bolts 60 and 61 as described for the previous embodiment. Manipulation of the hand lever can again, as in the previous embodiment, relieve the restraints upon the rope 6 and allow the load to descend faster. On the other hand the restraints can be reimposed by releasing the hand lever or even augmented by manipulation of the lever in the appropriate (in the case described clockwise) direction. It was stated above that the arrangement is made such that a load will descend slowly when the hand lever by which arm 46 is manipulated is left untouched. The purpose of this arrangement is to enable a load or series of loads to be lowered by the device under control of an operator at the top of the drop. If, however, the device is being used in an emergency it may well be that the operator himself will need to descend. This he will be able to do only if operation of the hand lever is not required to cause the load to descend since he must leave the device at the top. By suitable choice of the geometry of the pulley arrangement and of the rope (which must also include the physical characteristics of the rope) it can be arranged that operation of the cam 58 can cause the load to be held, in one position of the cam, or to descend slowly in the other position of the cam. The operator could then attach himself to the line while the line is held by the tubes 50 and 51, operate the lever, and then descend slowly. Alternatively the arrangement could be made so that he descends slowly with the cam 58 in one position or at a faster rate if he operates the cam before he applies himself as a load to the line.

It will be apparent that other configurations of rope could be devised to provide for different degrees of frictional restraint upon the passage of the rope through the machine. It will also be apparent that the device could be made to provide only a chosen one of the configurations described. Thus in all the configurations shown some of the pulleys are redundant and could be omitted from the construction. However, by providing the full symmetrical arrangement to which these various configurations have been applied a more versatile machine is produced which could be used at choice in a variety of situations merely by changing the manner in which the rope is threaded through the machine. To this end a machine having a readily removable cover could be employed so that rethreading the rope would present no difficulties. It will be appreciated that in the embodiments of FIGS. 6 and 7 both ends of the rope may be left to hang freely from the support device, and both ends may be provided with supporting harnesses so that they may be used alternately as the lowering run of the rope. When out of use it is preferred in these embodiments that one short end of rope should be free of the support device the remainder of the rope constituting the main length equivalent to the length of drop to be negotiated. This main length of rope can be held on a reel or in a pack but it is preferable that any such storage should be of a nature which enables the long end of rope to be rapidly deployed before operation commences.

It will be appreciated that in all the embodiments described the nature of the rope or other line material employed is important to the proper operation of the device since the stiffness (resistance to bending) and the surface characteristics of the rope, as well as its strength and resistance to burning are important. A rope which has been found to be highly suitable for the purpose is known as "11 mm Marlow Abseiling Rope, Special Reference 10-80, 100% Polyester".

It is to be appreciated that the speed limiting effect applied by the various means housed in the housing 11, interact together to produce the required speed limiting effect during lowering of the person. The zig-zag path of the rope 6 around the guide elements provides a basic speed limiting effect produced by friction at the fixed guide elements and also produced to some extent by the resistance caused by bending and unbending of the rope as it passes around the guide elements.

One factor which needs to be considered is the weight of the rope itself at the beginning of a descent, whether in a coiled state or hanging freely. If for example the rope is hanging freely, then the tension on the rope entering the support structure will be greater at the beginning of the descent than at the end, so that there may be a tendency for the device to descend more quickly towards the end of the descent. Whilst this may be acceptable for relatively short descents, it may be found preferable for the free end of the rope to be coiled, or otherwise stored, at the beginning of the descent, and for the coil to be suspended from the housing 11 itself. The coil of rope may be arranged in such a way that it can freely unwind and enter at the opening, so that the weight of the coil of rope does not itself place an additional tension on the rope entering the housing 11.

It is also to be appreciated that of course the general speed limiting effect of the device will include simple friction at the devices 50,51 and also to some extent at the guides 40,43 and at other places where the rope touches the structure. All these effects add to the basic, fixed, speed limiting effect on the rope. The variable speed limiting effect is provided by pivoting the transverse member 46 under the control of the bar 70.

In connection with the support of the rope below the housing 1 at the outset of the descent, there has been mentioned the possibility of allowing the rope to hang freely (on short descents), or of storing the rope on a reel supported from the casing. In another alternative, the rope may hang from the casing in such a manner that the rope emerges from the opening in the housing to hang freely over half its length, but has its free end attached to the housing so that the other half of its length hangs from the casing. Thus the rope may be arranged in a loop with half its weight putting a tension on the rope at the opening and half its weight being supported directly by the housing. As the housing passes down the rope, the weight of the rope hanging below remains divided equally in this way. As a result the tension on the rope at the opening (tending to slow the descent by its effect on the internal system) and the weight on the casing (tending to speed the descent by overcoming the friction of the system), both decrease together, giving a relatively steady descent. Further configurations of rope (other than a simple loop) can be arranged to give the same effect, for example the weight of a reel can be divided between tension in the rope at the opening and direct attachment to the housing.

Finally the four modes of operation shown in FIGS. 4, 4*a*, 5, 5*a*, 6, 6*a* and 7, 7*a* will be summarised.

Figure 4A:
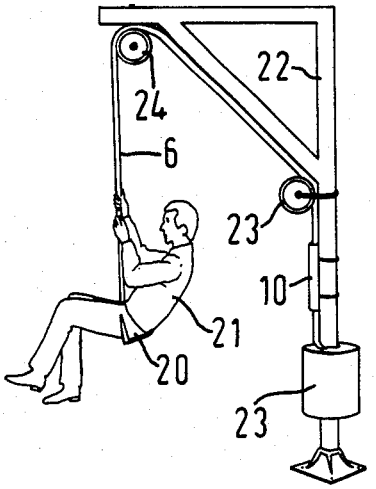
FIG. 4*a* is a perspective diagrammatic view showing one use of the device in this mode.

Referring to FIGS. 4 and 4*a*, this method of operation allows rapid descent for a predetermined number of people, each one using his own harness. In this method the support structure 10 is anchored and the rope 6, feeding from a rope dispensing drum 23, for example with a capacity of 750 meters, passes through the unit.

At arranged intervals, each person couples his seat onto the rope and is let down by an operator, using the control arm 70 on the support structure 11. In off-shore use, the last person down simply turns a cam on the machine (not shown) which locks the arm 70 into an open position, and rides down. Such a locking cam can be supplied for off-shore use as described. For land use, the last person down can descend as in the method of FIGS. 5 and 5*a*.

Referring to FIGS. 5 and 5*a*, the use in this second mode is that the rope is anchored securely at the higher level. The operator sits in the harness hooked to the support structure and lowers him or herself to the lower level by depressing the descent controller lever 70. Any number of people can then use the lowering device, using the following sequence. A person wanting to descend pulls the unit back up to the higher level using the rope. The ground end of the rope is then secured to the fixed point 19 and the previously anchored end is released and dropped to the ground. As the lowering device operates in either direction, the unit is now ready to use as in the original descent.

Referring to FIGS. 6 and 6*a*, in this method of operation the support structure is itself anchored at the upper level. This time, however, the rope is reefed through the unit in the different pattern, as shown, in such away as to allow it to travel up and down through the unit. Two harnesses are used and are secured at either end of the rope. The sequence of operation is as follows. The lowering device is operated from above. The first person descends with the rope to the lower level. The second person then descends in the second harness, and in so doing brings the first harness back up to the upper level as he or she descends. Any number of people can thus descend, using the two harnesses in a see-saw arrangement up and down. The last person down unfastens the machine and anchors the short end of the rope. The machine is then hanging in the upside down position and the last person can use the harness as in the second mode described with reference to FIGS. 5 and 5*a*.

Finally in the method of FIGS. 7 and 7*a*, the unit can be used to lower various kinds of objects, up to and for example 167 kilograms, to the ground under safe control. The unit is thus ideal for use in building construction, warehousing, or in any situation when a rope and pulley system might have been needed. Using the return rope system described with reference to FIGS. 6 and 6*a*, goods can be lowered safely using a fast rate of descent. The support structure is anchored at a fixed point 19 and operated from above with the rope for the second load returning up as the first load descends. For the fast descent the different route of rope is used as shown in FIG. 7.

I claim:

1. A lowering device comprising:

a line for lowering a load, a support structure engaged with the line in such a manner that upon lowering of the load the line runs through the support structure, a transverse pivoted guide member positioned transversely relative to the main extended length of the line in operation, the transverse guide member having two primary guide elements mounted thereon in spaced apart relationship and the transverse guide member being pivotally mounted on the support structure at a pivot axis substantially midway between the two primary guide elements, and manual control means coupled to the transverse guide member to effect pivotal movement thereof by an operator, the line being threaded along a path through the support structure such that the line passes around and bears against both primary guide elements on the transverse guide member and experiences a braking effect thereby, the route of the line through the support structure comprising a path through an opening in the support structure, a path around an arc of a first secondary guide element, a path between the first secondary guide element and a first primary guide element, a path around an arc of the first primary guide element, a path between the two primary guide elements leading back towards the said opening, a path around an arc of the second primary guide element returning to a direction away from the said opening, a path between the second primary guide element and a second secondary guide element, a path around an arc of the second secondary guide element, and a path through a further opening in the support structure, said further opening being positioned at a region of the support structure remote from the first opening with the guide member and the guide elements arranged in a region between the two openings, the path of the line through the support structure being such that tension in the line due to a load in operation produces a turning moment on the transverse guide member which pivots the transverse guide member to bring each primary guide element towards an associated secondary guide element mounted on the support structure with the line between the associated primary and secondary guide elements to increase the braking effect on the line, the manual control means being operable to increase or decrease the braking effect by turning the transverse guide member in the same or the opposite sense to the effect of the load tension in the line.

2. A device according to claim 1 in which the path of the line through the support structure is such that load tension in the line acting in either direction along the line produces a turning moment on the transverse guide member, and an arrangement of secondary guide elements is provided such that pivoting of the transverse guide member in either direction brings each primary guide element towards an associated secondary guide element.

3. A device according to claim 1 in which there is mounted on the transverse guide member midway between the two primary guide elements a further, tertiary guide element, said tertiary guide element being adapted for said line to pass around during passage of said line from one primary guide element to the other.

4. A device according to claim 3 in which the tertiary guide element is mounted to be freely rotatable on the transverse guide member.

5. A device according to claim 1 in which the periphery of each guide element, at least over the portion contacted by the line, is circular.

6. A device according to claim 1 in which the primary guide elements are fixed relative to the transverse guide member.

7. A device according to claim 1 in which the secondary guide elements are fixed relative to the support structure.

8. A device according to claim 1 in which the primary and secondary guide elements are positioned in a symmetrical arrangement on either side of a central longitudinal axis of the support structure, the said longitudinal axis passing through the said pivot axis of the guide member, and also being approximately aligned along the direction of the main extended length of the line in operation.

9. A device according to claim 1 in which the manual control means comprises an elongate control member aligned transversely of the main extended length of the line in operation and mounted for pivotal movement substantially about the mid point of the member, the elongate control member being adapted for two-handed manual operation with one hand on either side of the pivot axis of the member.

10. A device according to claim 1 in which there is provided in the region of each opening in the support structure for the line, tension means for placing a restriction on the passage of the line through the opening in order to tension the line during its passage through the support structure.

11. A device according to claim 10 in which there is provided in the region of an opening in the support structure for the line a pair of pinch rollers for the line to pass between for applying a restraint to passage of the line so as to tension the line during its passage through the support structure.

12. A device according to claim 10 in which there is provided in the region of at least one opening in the support structure for the line a pivoted tubular member through which the line passes, and adjustment means for varying the angle of the tubular means relative to the main extended length of the line in operation, for varying the restraint exerted on the line by the tubular member during the passage of the line therethrough.

13. A lowering device comprising:

a line for lowering a load, a support structure engaged with the line in such a manner that upon lowering of the load the line runs through the support structure, a transverse pivoted guide member positioned transversely relative to the main extended length of the line in operation, the transverse guide member having two primary guide elements mounted thereon in spaced apart relationship and the transverse guide member being pivotally mounted on the support structure at a pivot axis substantially midway between the two primary guide elements, and manual control means coupled to the transverse guide member to effect pivotal movement thereof by an operator, one end of the line being secured at a fixed point and the load being secured to the support structure which is arranged to travel with the load, the line being threaded along a path along the support structure such that the line passes around and bears against both primary guide elements on the transverse guide member and experiences a braking effect thereby, the route of the line through the support structure comprising a path through an opening in the support structure, a path around an arc of a first secondary guide element, a path between the first secondary guide element and a first primary guide element, a path around an arc of the first primary guide element, a path between the two primary guide elements leading back towards the said opening, a path around an arc of the second primary guide element returning to a direction away from the said opening, a path between the second primary guide element and a second secondary guide element, a path around an arc of the second secondary guide element, and a path through a further opening in the support structure, said further opening being positioned at a region of the support structure remote from the first opening with the guide member and the guide elements arranged in a region between the two openings, the path of the line through the support structure being such that tension in the line due to a load in operation produces a turning moment on the transverse guide member which pivots the transverse guide member to bring each primary guide element towards an associated secondary guide element mounted on the support structure with the line between the associated primary and secondary guide elements to increase the braking effect on the line, the manual control means being operable to increase or decrease the braking effect by turning the transverse guide member in the same or the opposite sense to the effect of the load tension in the line.

14. A lowering device comprising:

a line for lowering a load, a support structure engaged with the line in such a manner that upon lowering of the load the line runs through the support structure, a transverse pivoted guide member positioned transversely relative to the main extended length of the line in operation, two primary guide elements fixedly mounted on the transverse guide member in spaced apart relationship, the transverse guide member being pivotally mounted on the support structure at a pivot axis substantially midway between the two primary guide elements, a tertiary guide element mounted on the transverse guide member midway between the two primary guide elements, said tertiary guide element being mounted to be freely rotatable on the transverse guide member, a plurality of secondary guide elements fixedly mounted in a symmetrical arrangement on the support structure, a manual control member aligned transversely of the main extended length of the line in operation and mounted coaxially with the transverse guide member for pivotal movement substantially about the mid-point of the control member, the control member being adapted for two-handed manual operation with one hand on either side of the pivot axis of the member, the control member being coupled to the guide member in such a manner as to effect pivotal movement of the transverse guide member by turning movement of the control member by an operator, the line being threaded along a path through the support structure such that the line passes around and bears against both primary guide elements on the transverse guide member and experiences a braking effect thereby, the route of the line through the support structure comprising a path through an opening in the support structure, a path around an arc of a first secondary guide element, a path between the first secondary guide element and a first primary guide element, a path around an arc of the first primary guide element, a path between the two primary guide elements leading back towards the said opening, a path around an arc of the second primary guide element returning to a direction away from the said opening, a path between the second primary guide element and a second secondary guide element, a path around an arc of the second secondary guide element, and a path through a further opening in the support structure, said further opening being positioned at a region of the support structure remote from the first opening with the guide member and the guide elements arranged in a region between two openings, the path of the line through the support structure being such that tension in the line due to a load in operation produces a turning movement on the transverse guide member to bring each primary guide element towards an associated one of the said secondary guide elements with the line between the associated primary and secondary guide elements to increase the braking effect on the line, the path of the line being such that load tension in the line acting in either direction along the line produces a turning moment on the transverse guide member, the manual control member being operable to increase or decrease the braking effect by turning the transverse guide member in the same or the opposite sense to the effect of the load tension in the line.

* * * * *